US008284063B2

(12) United States Patent
Jensen et al.

(10) Patent No.: US 8,284,063 B2
(45) Date of Patent: Oct. 9, 2012

(54) PERIPHERAL EVENT INDICATION WITH PIR-BASED MOTION DETECTOR

(76) Inventors: Bradford B. Jensen, St. Joseph, MI (US); Kim I. McCavit, St. Joseph, MI (US)

( * ) Notice: Subject to any disclaimer, the term of this patent is extended or adjusted under 35 U.S.C. 154(b) by 599 days.

(21) Appl. No.: 12/322,914

(22) Filed: Feb. 9, 2009

(65) Prior Publication Data

US 2010/0201527 A1 Aug. 12, 2010

(51) Int. Cl.
*G08B 17/00* (2006.01)

(52) U.S. Cl. ..... 340/584; 340/606; 382/102; 382/103; 382/107; 361/161; 331/66

(58) Field of Classification Search ..... 340/584
See application file for complete search history.

(56) References Cited

U.S. PATENT DOCUMENTS 4,466,748 A * 8/1984 Needham ..... 374/129
5,712,622 A * 1/1998 Grossinger et al. ..... 340/555
6,137,407 A * 10/2000 Akagawa et al. ..... 340/552
6,268,395 B1 * 7/2001 Hattori ..... 514/530
6,288,395 B1 * 9/2001 Kuhnly et al. ..... 250/339.04
2011/0057105 A1 * 3/2011 Buckley et al. ..... 250/338.3

OTHER PUBLICATIONS

Pyroelectric Infrared Sensor, Nippon Ceramic Co., Ltd.

* cited by examiner

*Primary Examiner* — George Bugg
*Assistant Examiner* — Anthony D Afrifa-Kyei
(74) *Attorney, Agent, or Firm* — Paul W. O'Malley; Susan L. Firestone

(57) ABSTRACT

An apparent motion detector is provided with multiple response levels at differing degrees of sensitivity. The motion detector is based on use of a pyroelectric infrared sensor and conventional circuitry which generates an output signal the strength of which reflects transient temperature changes occurring within a field of view and distinguishable from background heat levels. The detector's response varies with the strength of the signal using a plurality of LED's which emit different colors or are driven at different intensities. The system generally will have a field of view defined by a lens system which is translucent to visible light and transparent to infrared. The lens system doubles as a back screen projection system for display of the indicator light.

10 Claims, 9 Drawing Sheets

PERIPHERAL EVENT INDICATION WITH PIR-BASED MOTION DETECTOR

BACKGROUND

1. Technical Field

The disclosure relates to passive infrared sensor-based motion detectors.

2. General Description

Motion detectors based on infrared sensing elements represent a specialized type of passive infrared (PIR) sensor called Passive Infrared-based Motion Detectors (PID). PIDs are routinely applied to security systems and for automatically actuated lighting systems which are intended to be triggered by movement of an object or body through the sensor's coverage area. PIDs do not literally detect "motion", but rather detect transient changes in temperature occurring within usually small and changing portions of the coverage area. These transient changes, or "apparent motion", can stem from movement of a warm bodied person or vehicle into or through the coverage area, producing a local area of higher temperature against the cooler background of the coverage area. Such transient changes can also be associated with movement of a body or an object colder than the background through the coverage area. An example of this would be ice floating on a warmer river.

A PID is usually built using a plurality of pyroelectric thin film sensors which are combined with appropriate circuitry to make the PID insensitive to changes in ambient temperature generally detected across the coverage area while remaining sensitive to the localized temperature changes likely to be associated with movement of objects of a different temperature in or through the coverage area. Ambient temperature changes generally occur more slowly and across more of the coverage area than changes observed upon the movement of objects through the area allowing generation of signals generally indicative of object movement based on transient localized changes in temperature in the coverage area. In a literal sense then, PID motion sensors could be considered "apparent" motion detectors since the changes they detect are not exclusively caused by motion of objects, however, the term "motion detector" is commonly used in the art.

Unfortunately, transient changes can also stem from events which have little or nothing to do with the movement of "objects of interest". Handling of localized, transient changes of temperature which are not the result of motion of an object of interest, but are instead associated with other events, for example wind induced motion of tree branches or changes in cloud cover, is an issue for PID based systems. Unusually large objects, or objects exhibiting a substantial deviation from ambient temperature may pass through peripheral portions of the coverage area (or just outside the intended coverage area) giving rise to undesirable triggering of lighting or security alerts ("false" triggers).

The sensor elements in PIDs produce what is basically an analogue signal subject to variation over time depending upon changes in the heat output, or reflection, within its field of view. Signal events must be accurately correlated with the motion of warm bodies of significant size moving into or out of the focused sensing zones. A warm person walking into a sensing zone can generate a relatively large change in the infrared energy in that sensing zone, causing the circuitry to interpret that change in infrared energy as motion. One difficulty a sensor has is distinguishing between signals which indicate object motion in the coverage area, in which case it is desirable to activate the lights, and other signals which are not caused by object motion but mimic the signal resulting from object motion and thus which result in activation of security lights. These false triggers or nuisance activations need to be minimized. Minimization of false trigger events has demanded careful aiming of PIDs if maximum sensitivity is to be employed. As a consequence, less than maximum PID sensitivity is sometimes used with less than optimal aiming of the device as a tradeoff to minimize installation time.

Prior art PIDs have been built which have included a secondary light which is activated whenever a signal is generated which is of sufficient magnitude to trigger activation of the primary lighting or to activate an alarm. In some applications the secondary light is activated for a relatively brief period compared to the primary lighting. The secondary light provides several advantages. One advantage is that initial installation is aided since an installer can determine the sensor coverage area by watching the secondary light turn on and off. The "on period of the secondary light is generally much shorter than the "on" period for the primary lights and often corresponds closely to when an object is actually in the coverage zone as opposed to the main lights which may have an "on" period of several minutes. Another advantage is that the secondary light can be left active during daylight hours when the primary lighting is inoperable to save power. Still another advantage is that the secondary light can serve as an indicator that the primary lighting has failed.

Prior art PIDs have often been used as part of an area security system for detecting intruders within a secured area. Upon detection of an intruder the primary lighting or an alarm is activated. A secondary light, if present, also turns when the intruder enters the secured area. While the primary lighting typically remains on for an extended period of time, for example five minutes, the secondary light typically turns off after just a few seconds and then, if additional object movement is detected within the coverage area, turns on again. The secondary light can flash on and off if the intruder moves around in or further into the coverage/secured area. However, intruders often vacate a secured area in response to activation of the primary lighting, particularly if the intrusion is innocent.

While PIDs have been built to accommodate ambient conditions, changes in ambient conditions can still affect the precise borders of a PID's coverage area and/or the minimum temperature differentials between an object and its background required to activate the primary lighting or alarm. False triggers, or failures to respond, may be more or less likely when the weather does not match the conditions prevailing on installation. Small changes in ambient conditions may cause signals that were just below the threshold necessary to activate the primary lights or alarm. A typical example would be a PID installed at the front of a house and inadvertently aimed so that traffic passing in front of the house was within its field of view but far enough away that the signals generated by passing cars were not large enough to activate the system's primary response. Should a vehicle later exhibit a substantial temperature contrast with the environment, often stemming from colder weather conditions, the signal may become large enough to trigger the system's primary and secondary response.

SUMMARY

A passive infrared motion detector has multiple response levels at differing degrees of sensitivity. The motion detector is based on use of a pyroelectric infrared sensor and on circuitry which generates an output signal the strength of which reflects transient temperature changes occurring within a field of view and which is distinguishable from background heat levels. The detector's response varies with the strength of the signal. One vehicle for expressing the response is generation of an indicator which varies with the strength of the output signal. This can be effected a number of ways. For example, a plurality of LED's which emit light in different colors may be used. Alternatively, a single LED can be illuminated at an intensity which varies with signal strength. Auditory systems can be used. Typically these preliminary responses are staged to occur upon comparison to a plurality of reference levels of decreasing sensitivity. The system's ultimate response, illumination of an area or triggering of an alarm for example, occurs when the output signal magnitude reaches the least sensitive reference level. The system generally will have a field of view defined by a lens system which is translucent to visible light and transparent to infrared light. The lens system can double for back screen projection of the indicator light output. For motion detection systems based on ranging and/or Doppler shifts occurring within a coverage area and basing a response on strength of the return signal, analogous indication mechanisms and provision of multiple reference levels may be provided.

DETAILED DESCRIPTION

Figure 1:
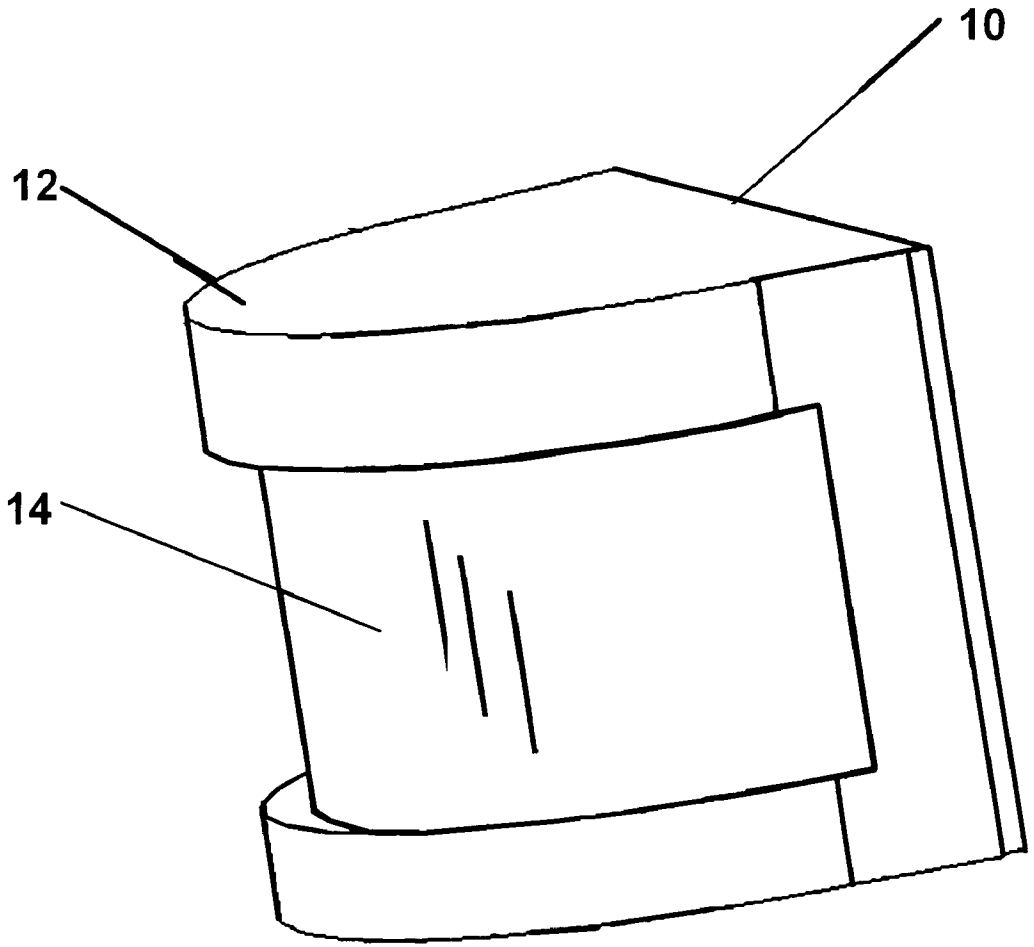
FIG. 1 is a perspective view of a passive infrared motion detector.

In the following detailed description, like reference numerals and characters may be used to designate identical, corresponding, or similar components in differing drawing figures. Furthermore, example sizes/models/values/ranges may be given. These are not intended to be limiting in most cases. In circuit diagrams, well-known power and ground connections, and similar well-known elements, may be omitted for the sake of simplicity of illustration.

Referring to FIG. 1, a PID based sensor 10 is illustrated comprising a housing 12 and a lens system 14 installed on the housing. Lens system 14 is preferably translucent to the visible light spectrum, but transparent to the infrared spectrum, which can help mitigate false triggers from visible light sources.

Figure 2:
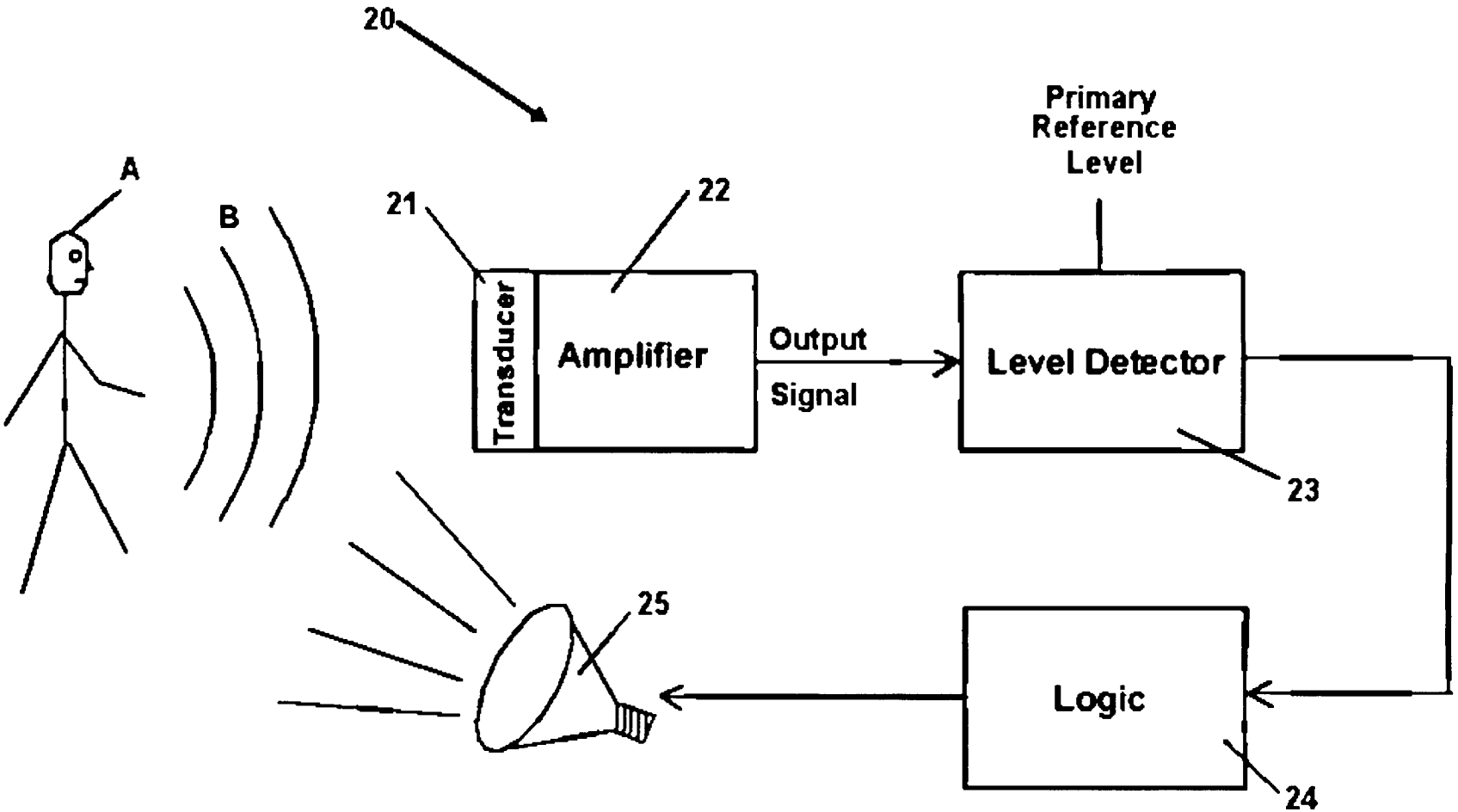
FIG. 2 is a block diagram of motion detection circuitry for a passive infrared sensor.

Referring to FIG. 2, a block diagram of representative PID circuitry 20 uses a transducer 21 based on thin films of pyroelectric material. The transducer(s) 21 is connected to an amplifier 22 (typically a differential amplifier). The transducer 21 is exposed to infrared radiation B radiated by an object A moving through or within the coverage area of a lens system 14. The transducer 21 is located behind the lens system 14 which together define a coverage area for a PID based sensor. A preferred transducer assembly is the Nippon Ceramic model RE200B (described at http://www.nicera.co.jp/pro/ip/pdf/pdfip001.pdf). The signal B, received by the transducer 21 could come from the reflection of a signal from a microwave or ultrasonic source (not shown), or direct radiation from the moving object as in the case of passive infrared motion sensors. Transducer 21 converts the infrared signals from the moving object into an electrical signal, which is amplified and filtered by the amplifier 22 of the PID circuitry 20. The output signal from the amplifier 22 is directed to the input of level detector 23 which compares the amplitude of the output signal to a primary reference level. If the amplitude of the output signal is of greater magnitude than the primary reference level, the level detector 23 sends a trigger signal to the logic block 24 indicating that a signal level consistent with detection of an object in motion is present. Logic block 24 may use one or more additional criteria, such as requiring multiple signals from the level detector or requiring low ambient light conditions, before activating the attached lighting 25. The level detector 23, primary reference level and logic 24 could also be implemented in software. The choice of the primary reference level is made to obtain the desired sensitivity, and range, while avoiding an excessive number of false triggers. If the motion sensing system is attached to a security system that activates an alarm, the tendency would be to limit the sensitivity to avoid false alarms.

The field of view or coverage area of a PID is usually defined by the focusing lens 14 disposed between an active surface of the sensor element 21 and the environment. In a typical application the focusing lens 14 is a polyethylene lens (preferably a Fresnel Lens) placed and shaped to collect energy in the form of a pattern of sensing zones (see FIG. 6 or 7) covering a portion of a broader field. The energy within the sensing zones is magnified. This arrangement is used to extend the range over which infrared energy can be detected.

A problem with this system lies in its application to motion sensing. The sensor element produces what is basically an analogue signal subject to variation over time depending upon changes in the heat radiated by objects and background within its coverage area. Signal events must be accurately correlated with the motion of warm bodies of significant size moving into or out of the focused sensing zones. A warm person walking into a sensing zone can generate a relatively large change in the infrared energy in that sensing zone, causing the circuitry to interpret that change in infrared energy as motion. A difficulty with such systems has been setting the coverage area such that, to the extent possible, only objects in motion through the coverage area drive the output signal level to a greater magnitude than the reference level and thereby trigger the primary response of the system. Signal levels which have a relatively high probability of resulting from peripheral or non-motion events should not exceed the reference level. To achieve this result the coverage area should be set to avoid locations likely to host peripheral or non-motion based events.

Figure 3:
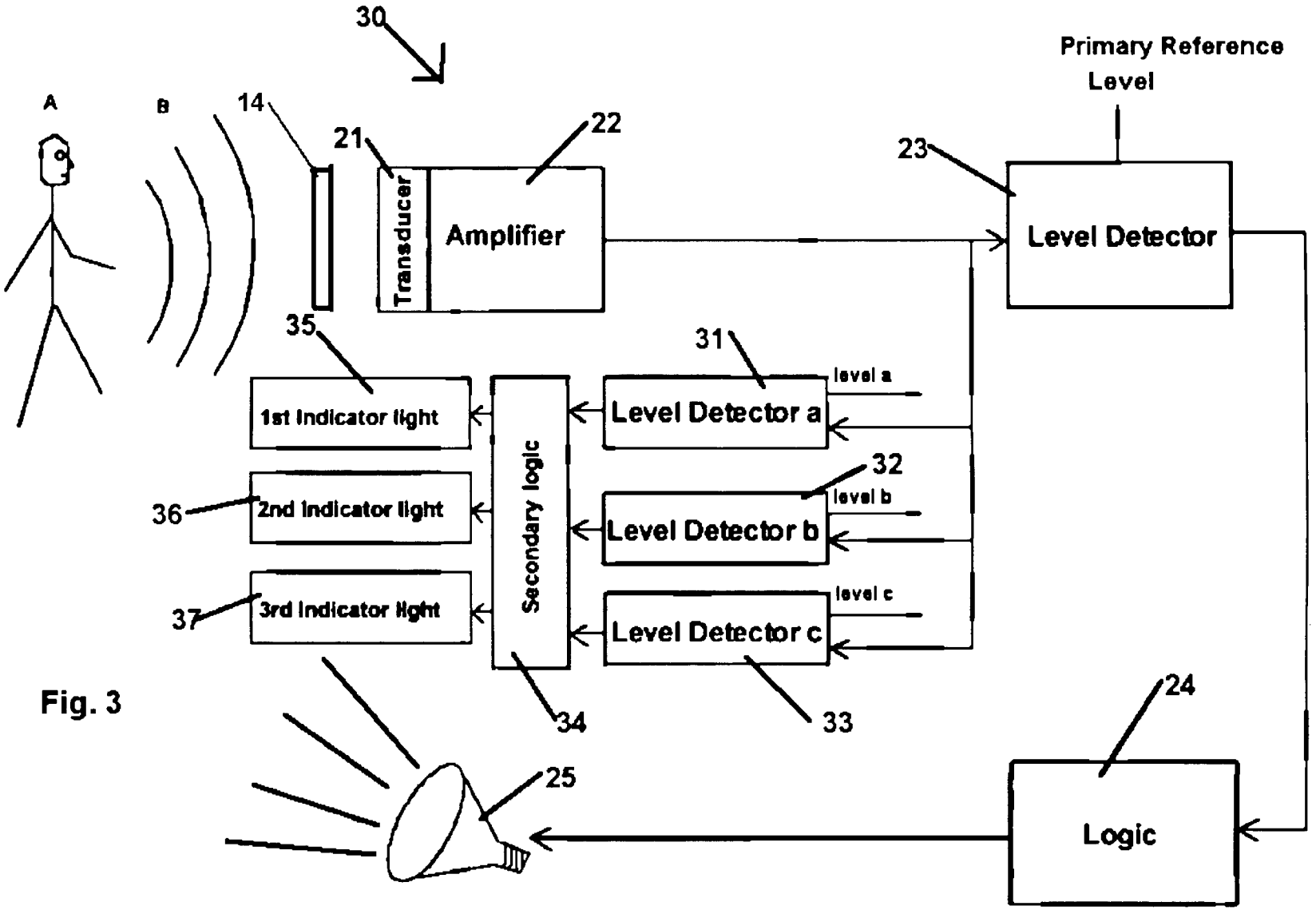
FIG. 3 is a block diagram of motion detection circuitry for a passive infrared sensor exhibiting multiple concurrent sensitivity levels.

FIG. 3 is a block diagram of motion detection circuitry 30 modified to implement multiple detection or reference levels. Level detectors 31, 32, 33 monitor the output signal from amplifier 22 and compare the amplitude of the output signal to each of three secondary reference levels; a, b, and c. In a conventional installation at least two of the three reference levels, and more typically all three secondary reference levels, are set to a lesser absolute magnitude than the primary reference level. As a result, level detectors 31, 32 and 33 successively generate discrete responses to the output signal as it reaches progressively larger absolute magnitudes (see FIG. 5). In other words, levels c, b and a, in that order, represent progressively increased sensitivity at the cost of the increasingly greater likelihood of false triggers. Secondary logic 34 is connected to receive the outputs from level detectors 31, 32, 33, and potentially other signals relating to certain necessary conditions, such as ambient light level or the position of control switches (not shown), to activate: a 1st indicator light 35 if the output signal is of greater absolute magnitude than level a; a 2nd indicator light 36 if the output signal is greater than level b; and a 3rd indicator light 37 if the output signal is greater than level c. It is not necessary that the exogenous conditions required for a response at any particular reference level be the same as those for another reference level. For example, the responses at secondary reference levels might be insensitive to ambient light levels while the response to the output signal exceeding the magnitude of the primary reference level might be inhibited at high ambient light levels. A secondary reference level might be set to the same magnitude as the primary reference level, but the response made conditional on different exogenous conditions. Secondary reference levels of course might be set higher than the primary reference level to be used to indicate bounds tighter than the current coverage area.

The indicator lights 35, 36, 37 are preferably low intensity lights such as LED's that are clearly visible to a person looking directly at the motion sensing system but which do not provide enough illumination to light up the area surrounding the motion sensing system. As a result, a higher degree of false triggers can be tolerated for activation of indicator lights 35, 36, 37 since they do not draw as much attention nor are as distracting as illumination of the higher wattage security lights 25. In one embodiment, the first indicator light 35 would be a low level, amber colored LED package activated in response to the output signal exceeding reference level a. Reference level a may be chosen to represent a four factor increase in sensitivity compared to the primary reference level. Since the infrared radiation from a moving object received at the PID 10 tracks the inverse square law, the result will be a doubling in effective range of PID 10. This would be expected to generate a substantial increase in false triggers. Similarly, the second indicator light 36 is arranged to have a sensitivity that is a factor of 2 greater than the sensitivity used to activate the security lights 25. The second indicator light 36 would also be an amber LED, but driven at a higher level than the first indicator light 35, so that it is illuminated at a brighter level than the first indicator light 35. The first indicator light 35 and the second indicator light 36 could be the same LED driven at two different levels. Finally, the third indicator light 37 could be a red LED set to a sensitivity level quite close to the sensitivity used to activate the high wattage security lights 25.

On approaching a PID which incorporates the circuitry of this disclosure and the indicator light system of the first embodiment, an intruder could see a low level amber glow as he approaches a PID motion sensing system, indicating that he has been detected. As the intruder moves closer, the amber LED 35 will glow more intensely, or change color, in response to the intruder's motions providing a clear indication that he has been detected and an implied warning that the system is active and about to respond to the intruder. If the intruder moves still closer, the red LED 37 will activate as a final warning that a response is imminent. Any further motion toward the motion sensing system will activate the high wattage security lights 25 and/or set off an alarm. The result is three additional layers of deterrence that occur before the intruder has activated the high wattage lights 25 and/or the alarm system.

Figure 4:
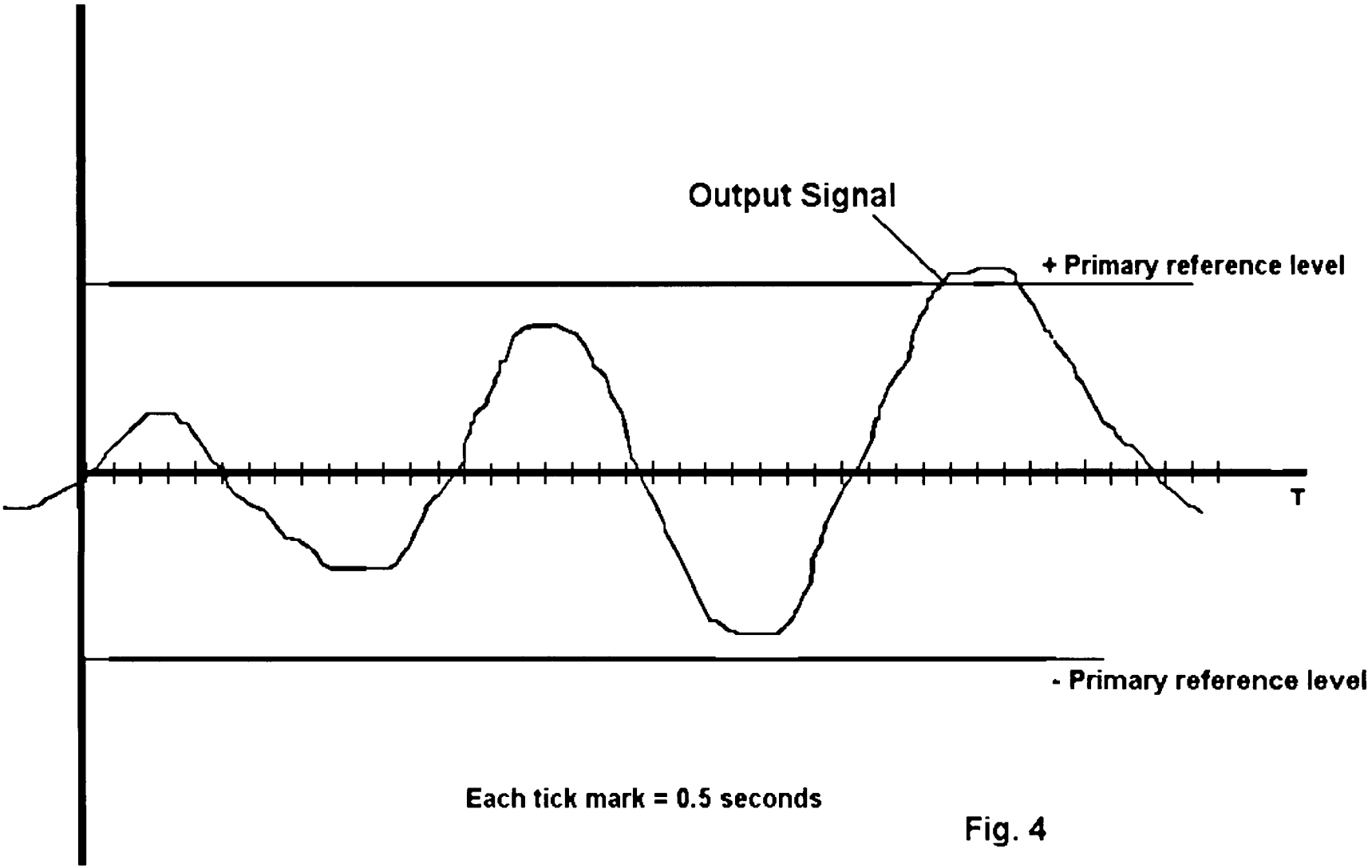
FIG. 4 is a graphical illustration of a possible output signal from a passive infrared sensor.
Figure 5:
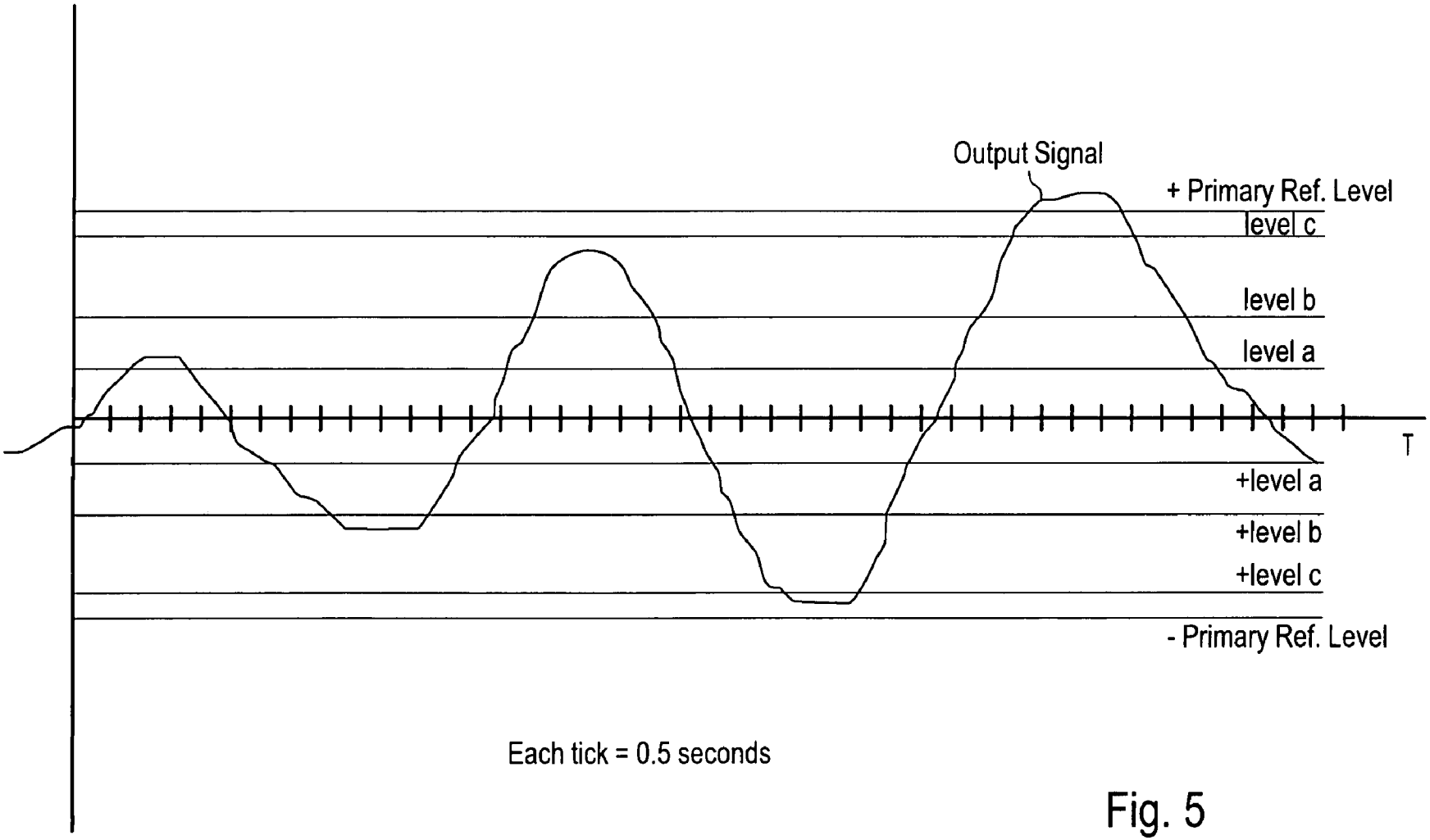
FIG. 5 is a graphical illustration of a possible output signal from a passive infrared sensor against a plurality of sensitivity trigger levels.

FIGS. 4 and 5 graphically illustrate a typical output signal from amplifier 22 as a moving object A approaches a motion detection system. FIG. 4 illustrates the response of a system having only a primary reference level setting while FIG. 5 illustrates a system incorporating a plurality of reference levels including a primary reference (defined as the reference level which results in generation of the systems intended response) and a plurality of secondary, higher sensitivity levels. As the object A approaches, or moves (as indicated by arrow C), into coverage zone rays 60 of the coverage area CA (see FIG. 6), the amplitude of the output signal grows in magnitude approaching the positive and negative primary reference levels. The amplitude of the output signal can eventually become greater than the primary reference level. At this point in time, the logic element 24 receives a signal from the level detector 23 and turns on the security lights 25. Once the primary reference level has been exceeded, the security lights 25 would typically remain on for a predetermined minimum period even with loss of the trigger signal.

Figure 6:
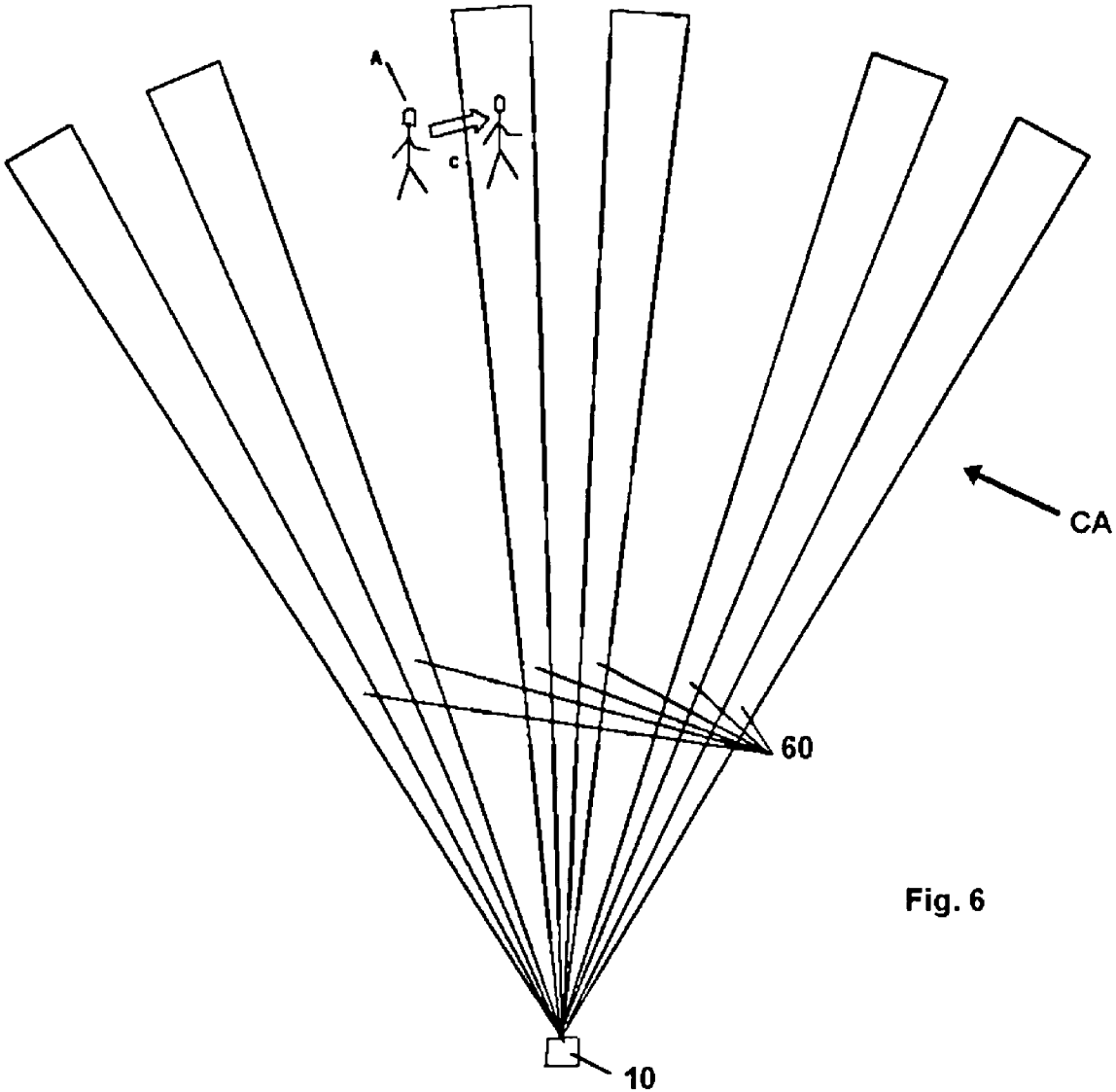
FIG. 6 illustrates the horizontal dispersion of detection zones within the coverage area for a passive infrared sensor based motion detector.

FIG. 6 shows a simplified diagram of the coverage zones 60 within the coverage area CA for a typical PID motion sensor. For simplicity in illustration, only six zones 60 are shown. To further simplify the drawing, only the horizontal plane is depicted. In actual applications the zone coverage is replicated, or something similar is provided, in the vertical plane. The coverage zones 50 are typically a plurality of pyramid shaped volumes extending outwardly from the face of the lens system 14. FIG. 6 includes a representation of a warm object A moving into one of the sensing zones 60 (as indicated by arrow C). When outside the sensing zone, only a very small fraction of infrared energy radiated by object A reaches the PID system. However, once inside a sensing zone 60, the lens system 14 focuses a much higher percentage of the IR energy onto the transducer 21. The change in incident IR energy on the transducer 21 from low intensity to high intensity results in a relatively large signal at the transducer 21 output. A typical response is that after a 0.4 seconds delay the high wattage lights 25 are activated. In this amount of time, a person may have traveled two or three feet further into the motion sensing zone 60, making it difficult to judge where the edge of the motion sensing zone actually began. In most cases this will give the installer the impression that the motion sensing zone is considerably narrower than it actually is.

FIG. 5 shows positive and negative reference levels for level a, level b, and level c. This allows the effective comparison of the absolute value of the output signal with the secondary reference levels, and the responsive illumination of the LEDs indicating which sensitivity level is being triggered. There are multiple indications from the indicator lights 35, 36, 37 of the magnitude of the apparent motion detected. LED indicator lights 35, 36 and 37 are preferably illuminated for relatively short periods compared with the activation period for an alarm or the primary lighting following a triggering event at the respective levels. In effect a variety of staged levels of response are produced.

Figure 7:
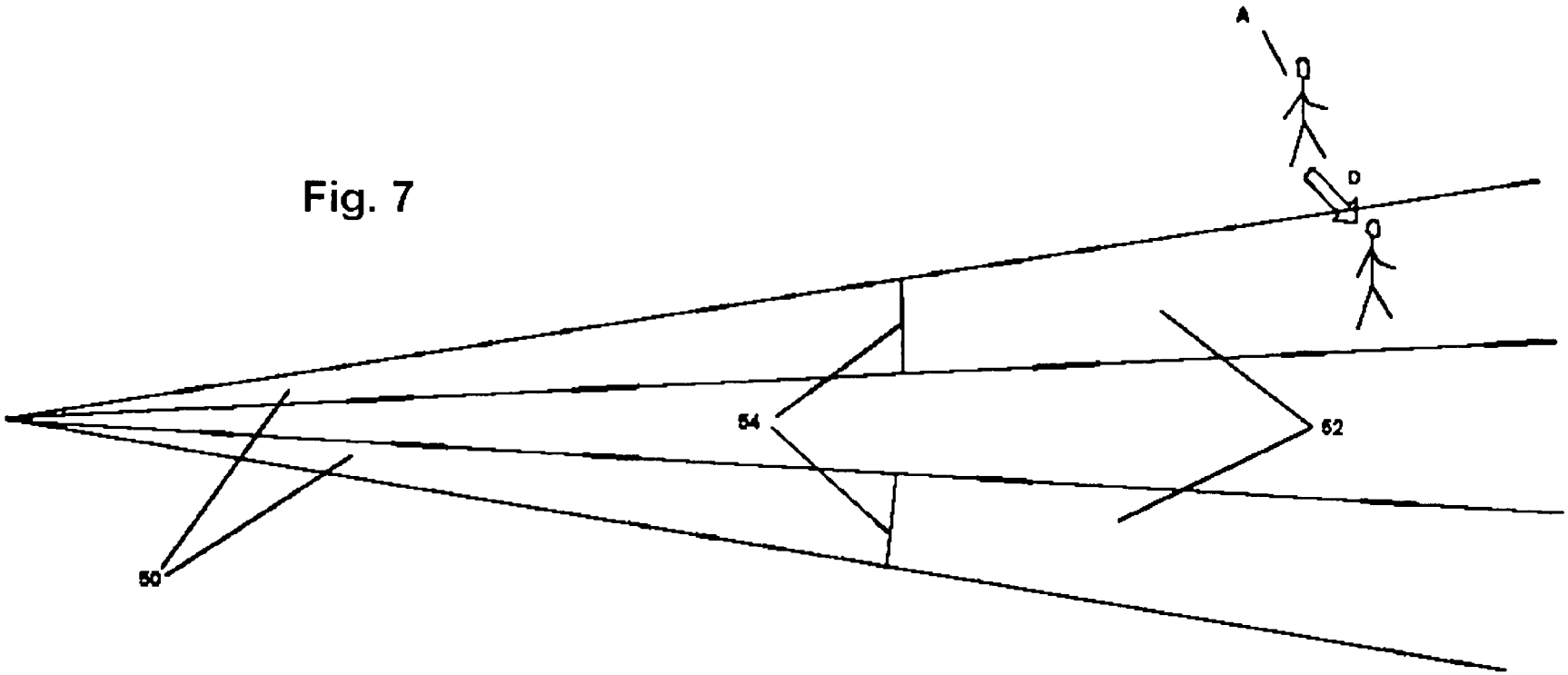
FIG. 7 illustrates distance limits for a horizontal pattern of detection zones within the coverage area of a passive infrared sensor.
Figure 8:
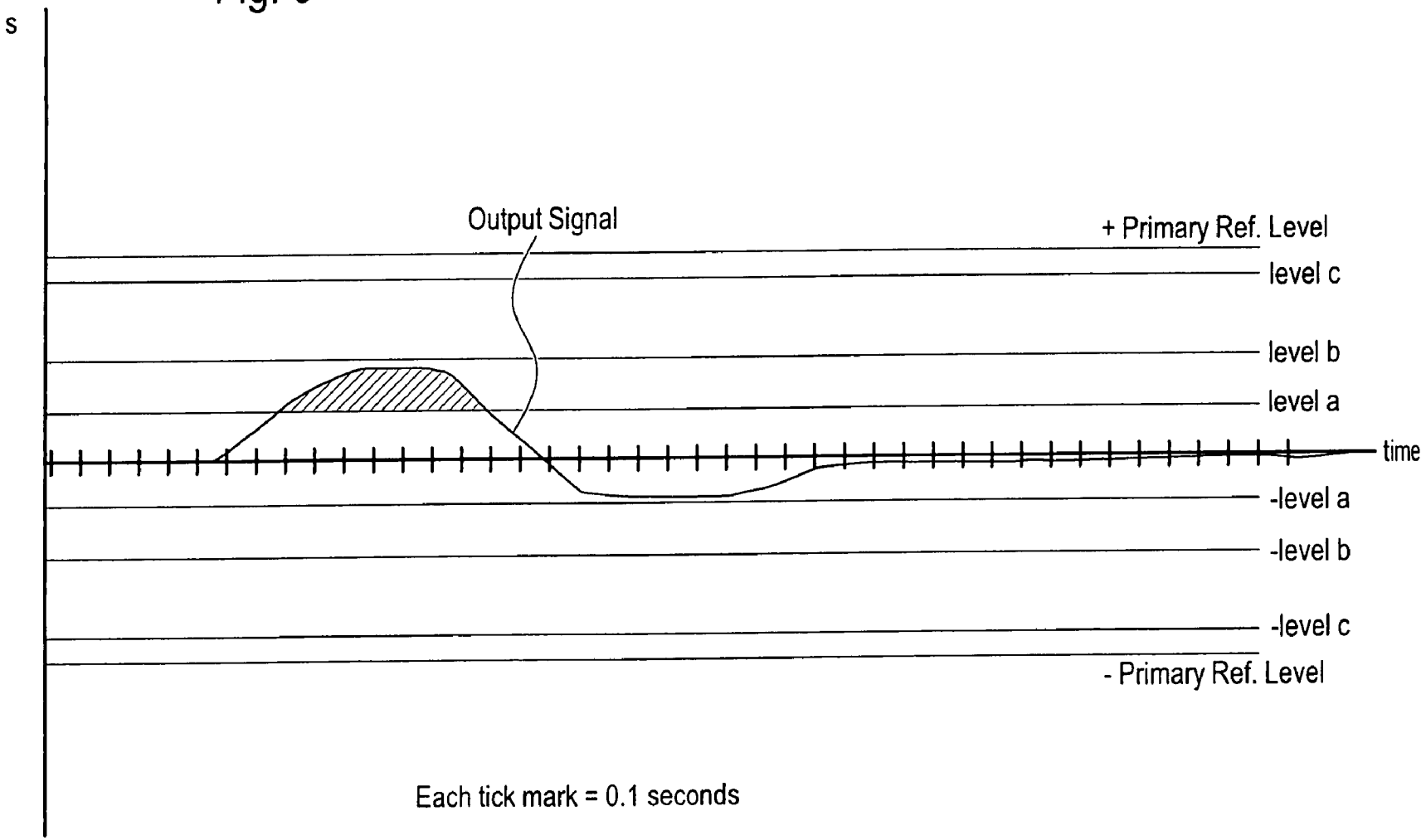
FIG. 8 graphs a possible output signal from a passive infrared sensor.

FIG. 7 illustrates generation of apparent motion signals that are created by objects substantially beyond the normal range of the PID. Two motion sensing zones 50, with extensions 52 are shown. Possible borders 54 between the zones 50 and extensions 52 are illustrated. The position of borders 54 would be quite fluid, being subject to the amount of heat radiated by and potentially by the speed of the object A to be detected. Borders 54 indicate only a maximum range of the PID on an average day for an average human being. A person or object moving into the motion sensing zone 50 would activate the high wattage lights 25. A person A moving into an extended sensing zone 52 (indicated by arrow D) would result in generation of an output signal as graphically illustrated in FIG. 8. Here the output signal does not exceed the primary reference level and the high wattage lighting 25 is not activated. However, since the output signal does exceed level a, the first indicator light 35 is activated.

Figure 9:
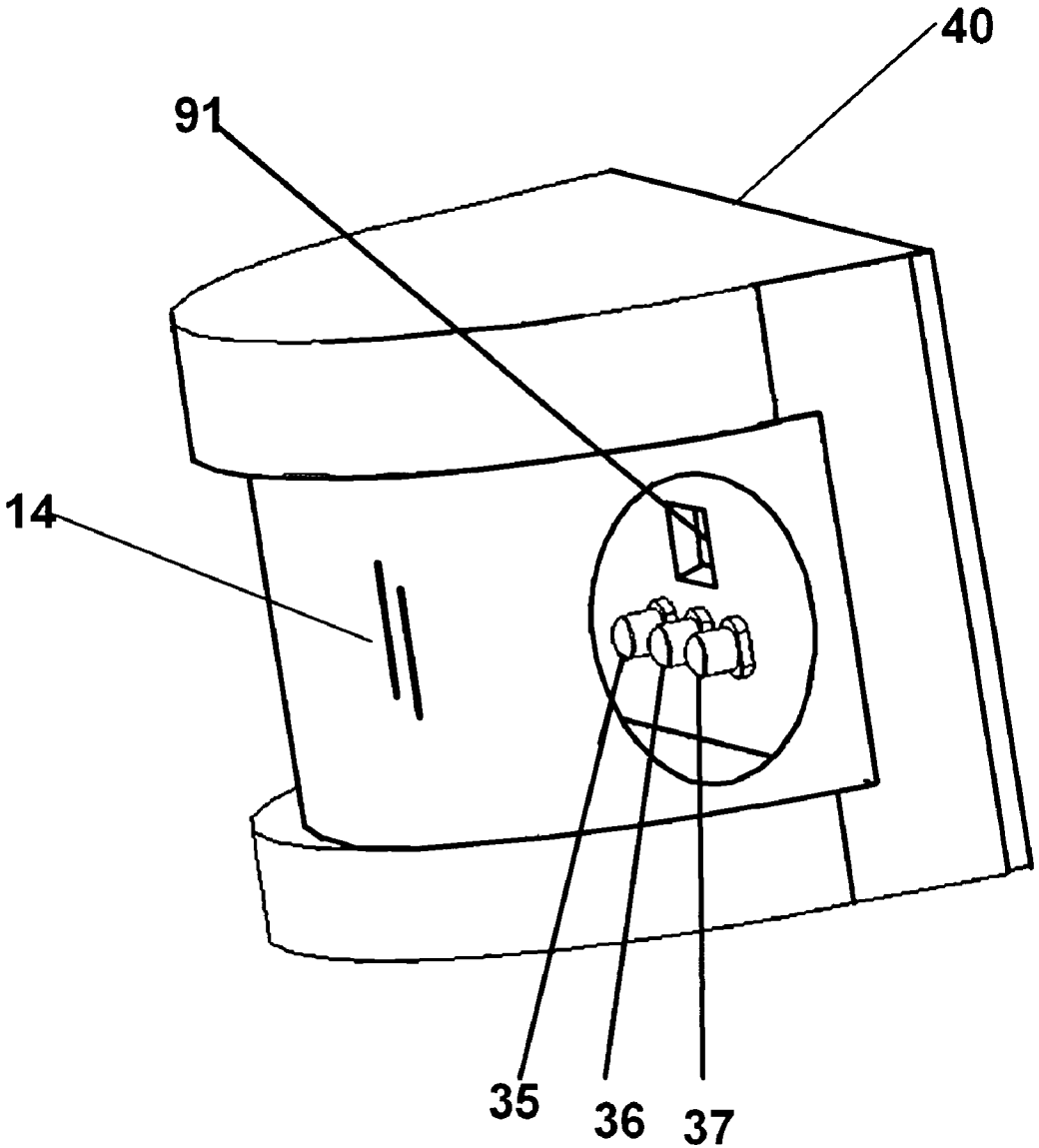
FIG. 9 is perspective view of an apparent motion detector incorporating multiple trigger level indicators.

FIG. 9 illustrates location of the invention that places the supplemental indicator lights 35, 36, 37 behind the lens system 14 of a PID 40 used for focusing infrared light on the sensor element of PID 91. The indicator lights 35, 36, 37 are arranged to illuminate the entire lens system 14 which is typically translucent to visible wavelengths of light. Illumination of the relatively large surface area of the lens 14, results in a display that is more visible to an intruder or installer than would be the relatively small surface areas of the individual LEDs. A sensor element is placed in recess 91 to avoid direct exposure of the pyroelectric sensor films to light emitted from LED indicator lights 35, 36, 37. Alternative arrangements of indicator lights based on an LED are possible. LEDs have become available which may be varied in color output. It is possible that the response of the system could be continuous variation of the color output, intensity output or flash rate depending upon signal strength. The LEDs will illuminate the lens system 14 from behind relative to the exterior of housing 12. Since lens system 14 is translucent to visible portions of the spectrum the lens system will appear to glow to an outside observer due to back screen projection on the lenses from the indicator LEDs 35, 36 and 37.

These concepts may also be extended to any motion detection system that generates proportional signals, e.g. microwave and ultrasonic systems. The system is applicable for false trigger identification, verifying coverage range and makes aiming easier.

What is claimed is:

1. A motion detector comprising:

a focusing element defining a field of view;

a passive infrared sensor element positioned with respect to the focusing element to define a plurality of sensing zones within pyramidal volumes projected forward from the focusing element, the sensing zones being within the field of view, and associated amplifier circuitry connected to the passive infrared sensor element for generating an output signal which varies in strength with transient changes in infrared radiation output occurring within the sensing zones of the field of view;

a reference level source providing a plurality of concurrent reference outputs of differing magnitudes;

logic for comparing the output signal to the reference outputs of the reference level source and generating comparison result signals responsive to the comparison; and an output signal strength indicator responsive to the comparison result signals for indicating the strength of the output signal having at least three different response levels, including none, as an aid in locating borders of the sensing zones.

2. A motion detector as claimed in claim 1 wherein the transient condition changes occur in the localized portion against a background temperature within the field of view.

3. A motion detector as claimed in claim 1, further comprising:

the output signal strength indicator includes a light source.

4. A motion detector as claimed in claim 1, the output signal strength indicator further comprising:

a lens system with the light source located to illuminate the lens system.

5. A motion detector as claimed in claim 4, the light source including a plurality of light emitting diodes.

6. A motion detector as claimed in claim 5, wherein the transient condition changes occur in the localized portion against a background temperature within the field of view.

7. A passive infrared motion detector comprising:

a housing;

a lens system located on the housing to collect and focus infrared radiation from a plurality of pyramidally shaped sensing zones within a coverage area;

an infrared sensor element and associated amplifier circuitry for generating an output signal which varies in strength with transient temperature changes occurring within the sensing zones;

a source of a plurality of reference levels of different magnitudes;

logic for comparing the output signal to the plurality of reference levels;

secondary logic responsive to the comparison for generating drive signals; and an indicator system responsive to the drive signals for indicating strength of the output signal against the plurality of reference levels.

8. A passive infrared motion detector as claimed in claim 7, wherein the indicator system includes a light emitting diode connected to the secondary logic to be illuminated responsive to the drive signals, the light emitting diode being located proximate to the lens system to illuminate the lens system from the interior of the housing.

9. A passive infrared motion detector as claimed in claim 7, the indicator system comprising a plurality of light emitting diodes connected to the secondary logic to be illuminated responsive to the drive signals, the plurality of light emitting diodes being located proximate to the lens system to illuminate the lens system from the interior of the housing.

10. A passive infrared sensor based motion detector comprising:

a lens system defining a plurality of pyramidally shaped sensing zones within a background;

means for detecting changes in infrared radiation in the pyramidally shaped sensing zones against the background and generating an output signal which varies in magnitude responsive with the intensity of the changes;

a source of a plurality of reference level signals;

logic for comparing the output signal to the plurality of reference level signals and generating trigger signals responsive to the outcome of the comparisons; and means responsive to the trigger signals for producing staged levels of response.

* * * * *